US008475208B2

(12) United States Patent
Simpson et al.

(10) Patent No.: US 8,475,208 B2
(45) Date of Patent: Jul. 2, 2013

(54) ELECTRICAL CONNECTOR CONFIGURED TO SHIELD CABLE-TERMINATION REGIONS

(75) Inventors: Jeffrey Stewart Simpson, Mechanicsburg, PA (US); Michael David Herring, Apex, NC (US); Arash Behziz, Newbury Park, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/301,123

(22) Filed: Nov. 21, 2011

(65) Prior Publication Data

US 2013/0130547 A1 May 23, 2013

(51) Int. Cl.
*H01R 13/66* (2006.01)

(52) U.S. Cl.
USPC ..... 439/607.01

(58) Field of Classification Search
USPC ..... 439/607.01, 607.23, 607.05, 607.07
See application file for complete search history.

(56) References Cited

U.S. PATENT DOCUMENTS

| | | | | |
|---|---|---|---|---|
| 5,632,634 | A | 5/1997 | Soes | |
| 6,036,539 | A | 3/2000 | Rigby et al. | |
| 6,409,543 | B1 * | 6/2002 | Astbury et al. | 439/607.07 |
| 7,249,974 | B2 * | 7/2007 | Gordon et al. | 439/607.41 |
| 7,508,681 | B2 * | 3/2009 | Payne et al. | 361/792 |
| 7,591,656 | B1 * | 9/2009 | Gretz | 439/108 |
| 7,637,767 | B2 * | 12/2009 | Davis et al. | 439/352 |
| 7,762,846 | B1 * | 7/2010 | Whiteman et al. | 439/607.23 |
| 7,780,474 | B2 * | 8/2010 | Ito | 439/607.05 |

* cited by examiner

*Primary Examiner* — Chandrika Prasad

(57) ABSTRACT

An electrical connector including a dielectric body and electrical contacts held by the dielectric body. The electrical contacts have a pair of signal contacts with respective mating ends configured to engage a communication connector and also with respective wire-terminating ends. The wire-terminating ends are located proximate to each other in a cable-termination region and are configured to mechanically and electrically couple to corresponding signal conductors of a cable. The electrical connector also includes a ground shield having a cover extension that extends over the cable-termination region. The cover extension is configured to shield the cable-termination region.

22 Claims, 6 Drawing Sheets

ELECTRICAL CONNECTOR CONFIGURED TO SHIELD CABLE-TERMINATION REGIONS

BACKGROUND OF THE INVENTION

The subject matter described and/or illustrated herein relates generally to an electrical connector that is configured to shield a cable-termination region where a communication cable couples to the electrical connector.

In some known electrical connector assemblies, an electrical connector includes an array of signal and ground contacts that are configured to couple to corresponding mating contacts of another connector. The signal and ground contacts are held by a dielectric body of the electrical connector in an arrangement that is configured to achieve a desired electrical performance. The signal and ground contacts include mating portions that engage the corresponding electrical contacts and terminal portions that engage communication cables. The communication cables include a pair of signal conductors and one or more drain wires. The signal conductors and the drain wires are mechanically and electrically coupled (e.g., by soldering) to the signal contacts and the ground contacts, respectively, at cable-termination regions. These regions can be a source of unwanted crosstalk in an electrical connector and, as such, it may be desirable to shield the cable-termination regions from each other and from other electrical connectors.

Depending upon different factors, such as the configuration of the array of signal and ground contacts and the electrical connector's environment, it may also be desirable to use one type of cable construction over other cable constructions. For example, cables that have only a single drain wire and a parallel pair of signal conductors may be more suitable for aligning and terminating with the signal and ground contacts of the electrical connector. However, such single-drain cables may be more difficult to bend or manipulate in some environments. Cables with two drain wires and a parallel pair of signal conductors may perform electrically better than cables with only one drain wire, but these dual-drain cables may lack flexibility.

In addition to the above limitations, both the single-drain and dual-drain cable constructions may not properly align with the signal and ground contacts of the electrical connector. As such, it may be necessary to manipulate the drain wire, such as by crossing the drain wire over one of the signal conductors, before terminating the signal conductors and the drain wire(s) to the electrical connector. Such cross-overs may have a negative impact on electrical performance and can also increase the number of physical manipulations that are performed during the terminating process, which can increase a cost of manufacture and/or a risk of damaging the components of the connector assembly.

In another cable construction, two signal conductors may be twisted about a single drain wire. This twisted-pair configuration may be more flexible than the other cable constructions. However, it may also be necessary, as described above, to cross the drain wire over one of the signal conductors before terminating to the electrical connector.

Accordingly, there is a need for an electrical connector that facilitates termination of different cable types and provides improved shielding to enhance electrical performance.

BRIEF DESCRIPTION OF THE INVENTION

In one embodiment, an electrical connector is provided that includes a dielectric body and electrical contacts held by the dielectric body. The electrical contacts have a pair of signal contacts with respective mating ends configured to engage a communication connector and also with respective wire-terminating ends. The wire-terminating ends are located proximate to each other in a cable-termination region and are configured to mechanically and electrically couple to corresponding signal conductors of a cable. The electrical connector also includes a ground shield having a cover extension that extends over the cable-termination region. The cover extension is configured to shield the cable-termination region.

Optionally, the dielectric body, the electrical contacts, and the ground shield define a contact module. The electrical connector may also include a plurality of the contact modules.

In another embodiment, a connector assembly is provided that includes a cable having signal conductors and a drain wire. The connector assembly also includes an electrical connector including a dielectric body and electrical contacts held by the dielectric body. The electrical contacts include a pair of signal contacts having respective mating ends configured to engage a communication connector and also having respective wire-terminating ends. The wire-terminating ends are located proximate to each other in a cable-termination region. The signal conductors of the cable are mechanically and electrically coupled to the wire-terminating ends. The electrical connector also includes a ground shield that is coupled to the dielectric body. The ground shield has a cover extension that extends over the cable-termination region to shield the cable-termination region.

In yet another embodiment, an electrical connector is provided that includes contact modules. Each of the contact modules includes a dielectric body and electrical contacts held by the dielectric body. The electrical contacts include a pair of signal contacts having respective mating ends configured to engage a communication connector and also having respective wire-terminating ends. The wire-terminating ends are located proximate to each other in a cable-termination region and configured to mechanically and electrically couple to corresponding signal conductors. The electrical connector also includes module shields that separate the signal contacts of one contact module from the signal contacts of an adjacent contact module. The electrical connector also includes a connector shield that is attached to the contact modules and electrically coupled to each of the module shields.

DETAILED DESCRIPTION OF THE INVENTION

Figure 1:
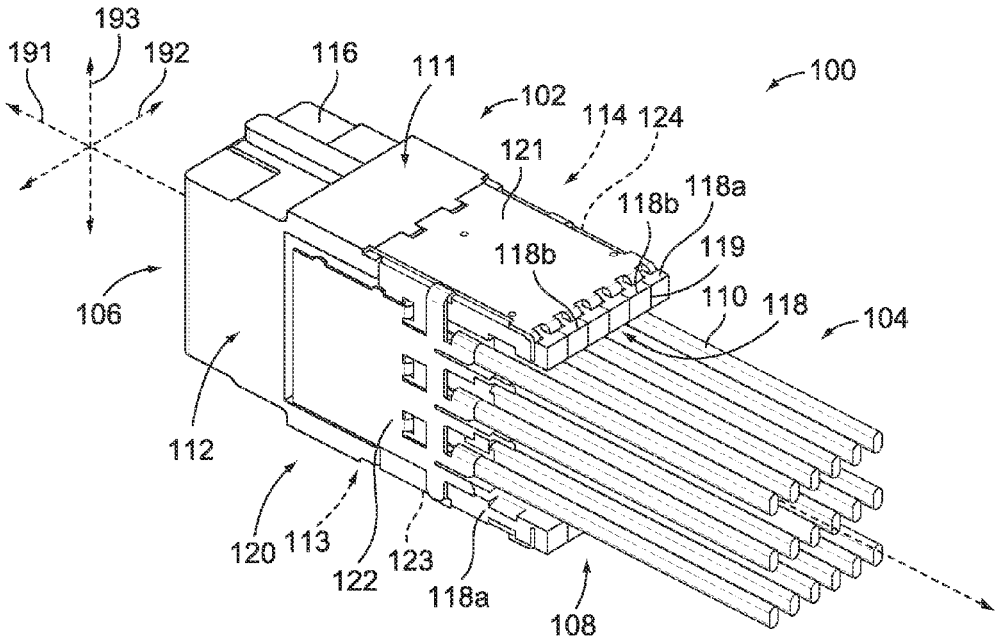
FIG. 1 is a perspective view an electrical connector assembly formed in accordance with one embodiment.

FIG. 1 is a perspective view an electrical connector assembly 100 formed in accordance with one embodiment. The connector assembly 100 is oriented with respect to mutually perpendicular axes 191-193, which include a central mating axis 191 and lateral axes 192, 193. As shown, the connector assembly 100 includes an electrical connector 102 and a cable assembly 104. The electrical connector has a mating face 106 and a loading side 108 that face in opposite directions along the mating axis 191. The mating face 106 is configured to mate with a mating connector (not shown). The cable assembly 104 includes a plurality of communication cables 110 that are communicatively engaged to the electrical connector 102. Also shown, the electrical connector 102 includes connector sides 111-114 that extend generally along the mating axis 191 between the mating face 106 and the loading side 108.

In an exemplary embodiment, the electrical connector 102 is a receptacle connector configured to mate with a header connector of a high-speed differential connector system. For example, the electrical connector 102 may be similar to a Z-Pack TinMan® connector developed by Tyco Electronics. However, although the connector assembly 100 is described with particular reference to high speed, differential-type systems, it is understood that embodiments described herein may be applicable to other applications that use electrical connectors.

As shown, the electrical connector 102 includes a connector housing or body 116 and contact modules 118 that are operatively engaged to the connector housing 116. The connector housing 116 is configured to receive portions or sections of the contact modules 118 and hold the contact modules 118 in fixed positions with respect to one another. The contact modules 118 can be stacked side-by-side as shown in FIG. 1 along the lateral axis 192. In one embodiment, adjacent contact modules 118 may directly abut each other with an interface 119 located therebetween. As shown, the contact modules 118 include two outer contact modules 118A and inner contact modules 118B that are located between the outer contact modules 118A. In the illustrated embodiment, there are four inner contact modules 118B, but there may be fewer or more in other embodiments. In alternative embodiments, there may be only one or two contact modules 118.

The connector housing 116 may have an open-sided configuration in which the outer contact modules 118A are exposed along the respective connector sides 112, 114. The connector housing 116 includes the mating face 106. In an exemplary embodiment, the mating face 106 has socket cavities (not shown) that are sized and shaped to receiving mating contacts (not shown) from the mating connector.

In particular embodiments, the electrical connector 102 has an outer shield assembly 120. The shield assembly 120 has a plurality of ground shields 121-124. As used herein, a "ground shield" may be used to shield an electrical circuit from electromagnetic interference. A ground shield can be a module shield that shields electrical contacts of a contact module, or a ground shield can be a connector shield that shields an electrical connector from external electromagnetic interference. The shield assembly 120 surrounds the mating axis 191 and the contact modules 118. In an exemplary embodiment, the shield assembly 120 can define an outer perimeter or periphery of the electrical connector 102.

Figure 2:
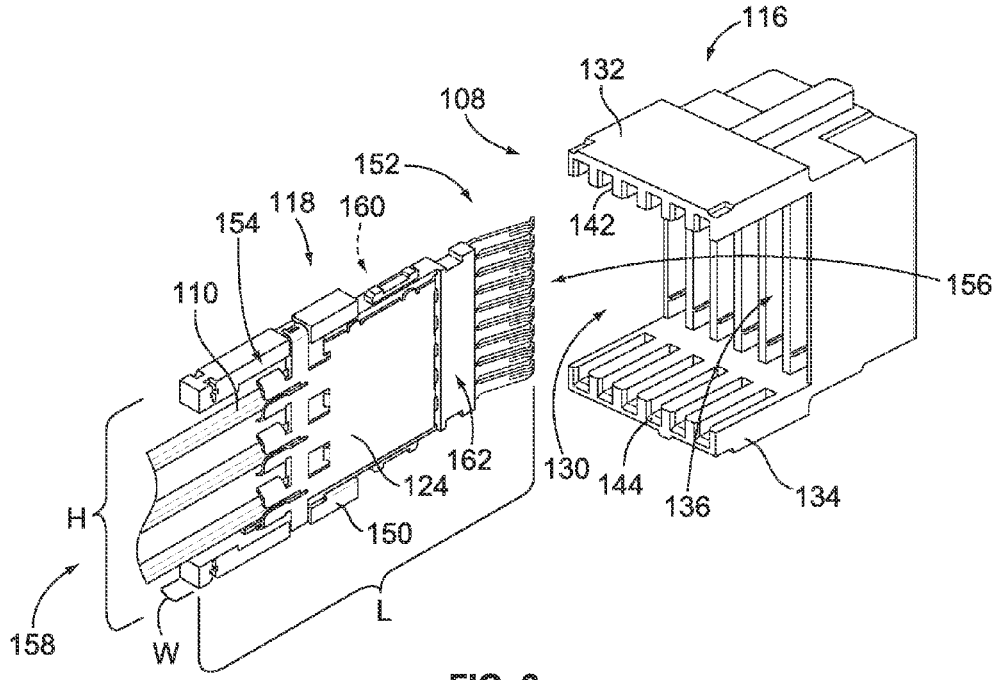
FIG. 2 illustrates a contact module and a connector housing of the connector assembly of FIG. 1.

The ground shields 121-124 include connector shields 121, 123, and module shields 122, 124 (shown in FIG. 2). The module shields 122, 124 are coupled to or are part of the contact modules 118. The module shields 122, 124 extend parallel to the mating axis 191 and, more specifically, parallel to a plane defined by the mating axis 191 and the lateral axis 193. The connector shields 121, 123 are engaged to the contact modules 118. The connector shields 121, 123 extend transverse or orthogonal to the module shields 122, 124 and parallel to a plane defined by the mating axis 191 and the lateral axis 192. As will be described in greater detail below, the ground shields 121-124 may be electrically coupled to each other.

In particular embodiments, the communication cables 110 include twisted-pair cables. Twisted-pair cables have a drain wire and a pair of signal conductors that are twisted about the drain wire along a length of the cable. However, embodiments described herein may also be suitable for other cable constructions. For example, in alternative embodiments, the communication cables 110 may have a single drain wire that is located between or extends alongside a pair of parallel signal conductors. As another example, the communication cables 110 may include two drain wires that extend parallel to each other and a parallel pair of signal conductors that extend between the two drain wires.

FIG. 2 shows a single contact module 118 and the connector housing 116. The connector housing 116 includes a recess 130 along the loading side 108. The recess 130 is configured to receive the contact modules 118 and is located between opposite shroud portions 132 and 134 of the connector housing 116. The recess 130 provides access to module cavities 136 of the connector housing 116. The module cavities 136 are sized and shaped to receive respective contact modules 118. Although only one contact module 118 is shown, the connector housing 116 in FIG. 2 is configured to receive six contact modules 118. The shroud portions 132, 134 include respective housing slots 142, 144. Each housing slot 142 directly opposes one housing slot 144. Opposing housing slots 142, 144 cooperate to guide one contact module 118 toward a corresponding module cavity 136 that receives the contact module 118.

The contact module 118 may include a dielectric body 150 and electrical contacts 152 that are held by the dielectric body 150. The dielectric body 150 has first and second body sides 160, 162 that face in opposite directions along the lateral axis 192 (FIG. 1). The contact module 118 includes the module shield 124, which is coupled to the dielectric body 150. The module shield 124 is configured to separate and shield the electrical contacts 152 of the corresponding contact module 118 from the electrical contacts 152 of an adjacent contact module 118 (not shown in FIG. 2). The module shield 124 can be attached to the body side 162. In some configurations, the contact module 118 includes only one module shield 124. However, in other configurations, the contact module 118 includes a module shield along each of the body sides 160, 162. For example, with reference to FIG. 1, the module shield 122 of the outer contact module 118A may oppose a module shield 124 while the other outer contact module 118A may have only one module shield 124.

Figure 5:
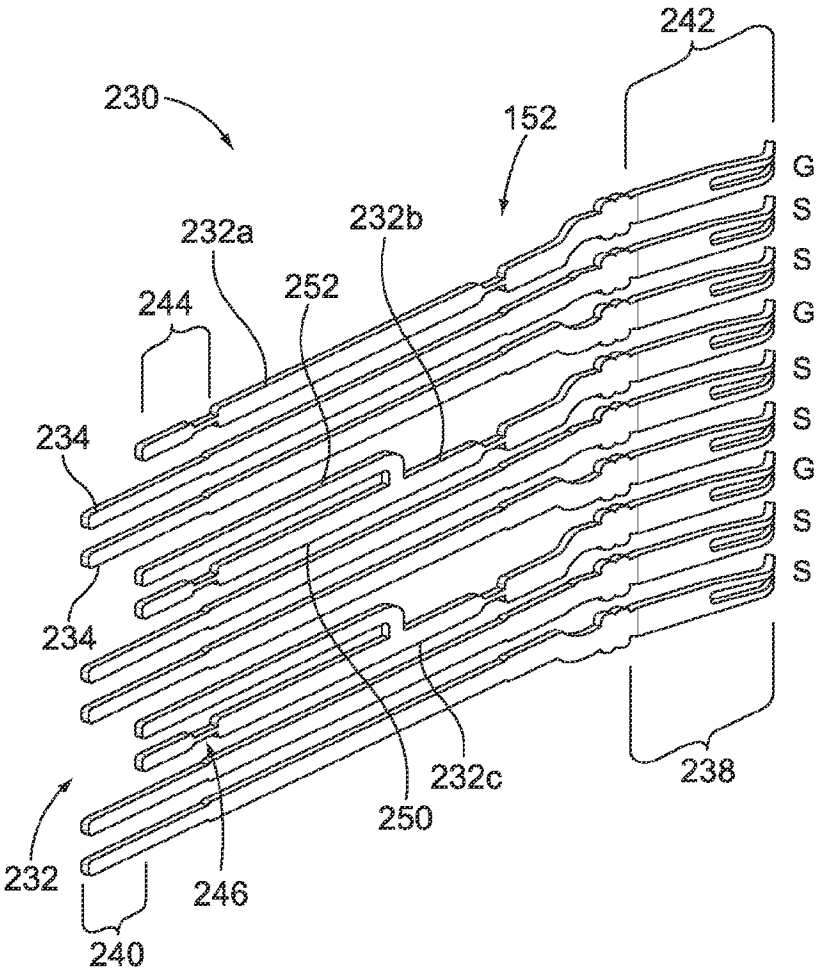
FIG. 5 is an isolated view of electrical contacts that may be used in the contact module of the connector assembly of FIG. 1.

The electrical contacts 152 may be part of a lead frame 230 (shown in FIG. 5). In some embodiments, the dielectric body 150 is manufactured using an overmolding process. During the overmolding process, the lead frame 230 is encased in a dielectric material, such as a plastic material, which forms the dielectric body 150. Optionally, the contact module 118 may be manufactured in stages that include more than one overmolding processes (e.g. an initial overmolding and a final overmolding). However, the dielectric body 150 can also be manufactured using other manufacturing processes. For example, rather than being overmolded, the dielectric body 150 may be manufactured from a plurality of separate components that are coupled together around the electrical contacts 152.

As shown in FIG. 2, the contact module 118 includes a leading end 156 and a loading end 158. The leading end 156 is configured to be inserted through the recess 130 of the loading side 108 and into a corresponding one module cavity 136. The contact module 118 has a height H, a length L, and a width W. In particular embodiments, the contact modules 118 are elongated or card-like structures in which two dimensions of the contact module 118 are significantly greater than the other dimension. For example, the height H and the length L can be at least four or five times greater than the width W.

As will be described in greater detail below, the communication cables 110 engage the contact module 118 at cable-termination regions 154. The module shield 124 is configured to cover the cable-termination regions 154. As used herein, a "cable-termination region" includes a spatial region where a pair of signal conductors of a communication cable are mechanically and electrically coupled to electrical contacts of the contact module. For instance, a cable-termination region may include the exposed portions of the signal conductors and the exposed portions of the electrical contacts. The pair of signal conductors may include a signal path and a return path. FIG. 2 shows three cable-termination regions 154 for the contact module 118. In other embodiments, fewer or more cable-termination regions 154 may exist (e.g., only a single cable-termination region 154 may exist).

As used herein, the term "mechanically coupled" and the like includes an attachment of one element to another element. For example, a conductor is mechanically coupled to a contact when the conductor and the contact are soldered or welded together. As another example, a shield is mechanically coupled to one or more contacts when the shield frictionally engages (e.g., through interference fit) the contacts. As used herein, the term "electrically coupled" and the like includes a direct electrical connection and an indirect electrical connection between two elements. An indirect electrical connection exists when one or more intervening components are between the two elements along the circuit or conductive pathway. When not modified by the words mechanical or electrical, the term "couple" and the like includes direct coupling and indirect coupling where one or more intervening components join the two elements.

The module shield 124 is configured to separate and shield the cable-termination regions 154 of adjacent contact modules 118. Optionally, the module shield 124 may also shield cable-termination regions 154 of one contact module 118 from other cable-termination regions 154 of the same contact module 118. The module shield 124 may also function as a common ground shield that is electrically coupled to the grounds of each of the communication cables 110.

In an exemplary embodiment, the module shield 124 is a single piece of sheet material that is stamped and formed. However, in other embodiments, the module shield 124 may include more than one part or component. For example, an alternative module shield 124 may have a separate shielding structure located for each differential pair of electrical contacts 152. The separate shielding structures may be electrically coupled to each other to form the module shield along the body side 162. In alternative embodiments, the separate shielding structures are not electrically coupled to each other.

Figure 4:
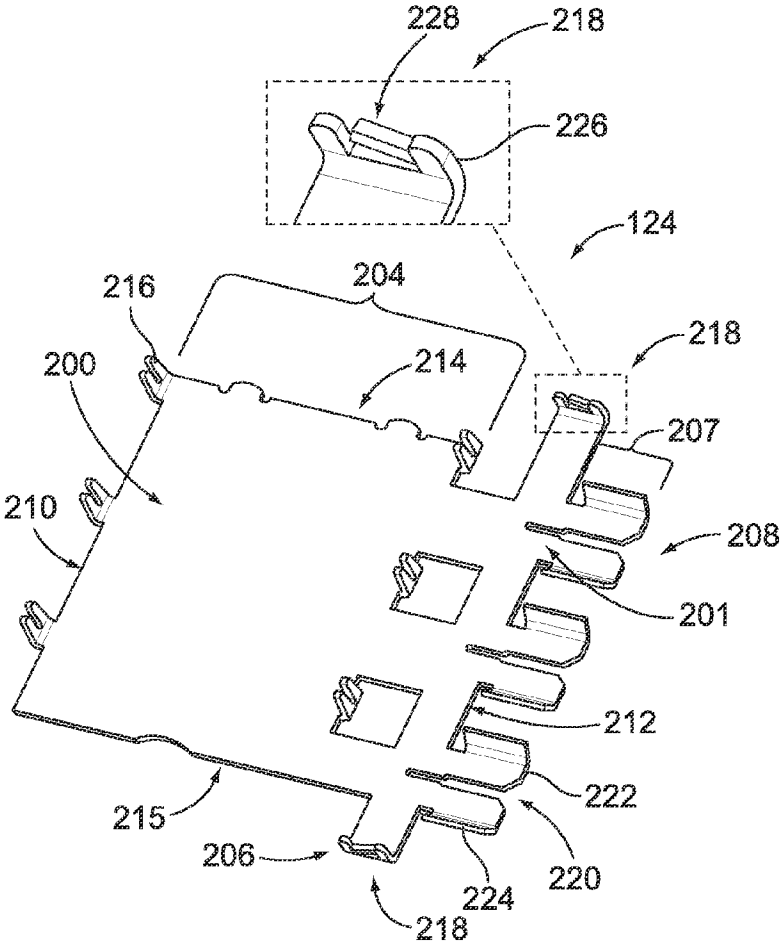
FIG. 4 is another perspective view of the module shield.
Figure 3:
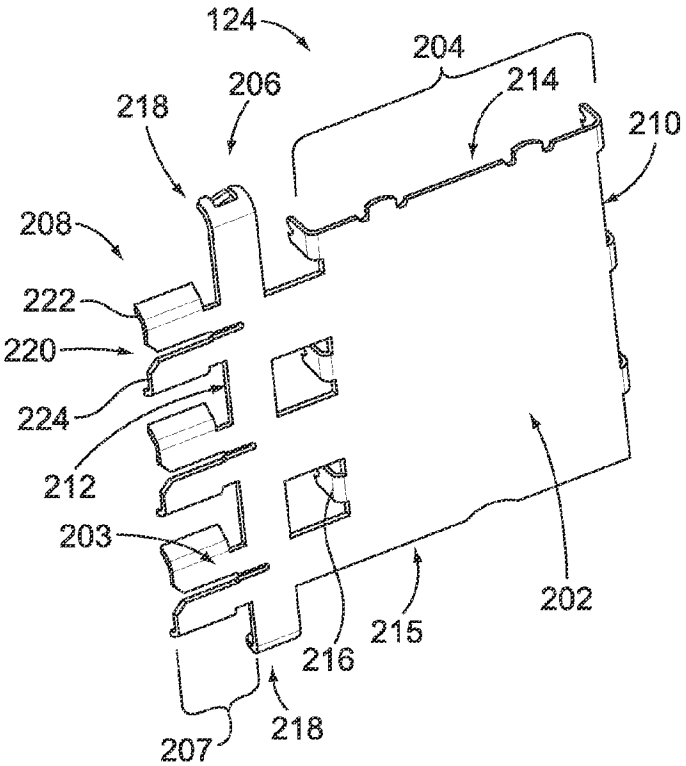
FIG. 3 is a perspective view of a module shield that may be used with the connector assembly of FIG. 1.

FIGS. 3 and 4 are different perspective views of the module shield 124. The module shield 124 has opposite side surfaces 200, 202. FIG. 3 shows the side surface 202, and FIG. 4 shows the side surface 200. In an exemplary embodiment, the module shield 124 includes a base portion 204, a connector portion 206, and a cover portion 207. As shown, the module shield 124 includes a leading edge 210, a trailing edge 212, and side edges 214, 215 that extend therebetween. When the electrical connector 102 (FIG. 1) is assembled, the side edges 214, 215 may extend generally parallel to the mating axis 191 (FIG. 1) and the leading and trailing edges 210, 212 may extend generally parallel to the lateral axis 193 (FIG. 1).

The module shield 124 may include various structural features that are configured to electrically couple to a conductive element of the electrical connector 102 and/or mechanically couple to an element that may or may not be conductive. By way of example, the structural features of the module shield 124 can include coupling elements 216 that are configured to engage a corresponding ground contact as described below, cover extensions 208 that are configured to shield corresponding cable-termination regions 154 (FIG. 2), and body connectors 218 that are configured to attach the module shield 124 to the dielectric body 150 or other suitable component(s) of the electrical connector 102.

As shown in FIGS. 3 and 4, each of the cover extensions 208 projects from the trailing edge 212 in a rearward direction (i.e., toward the loading side 108 (FIG. 1)). The cover extensions 208 are configured to reduce or control the effects of crosstalk generated within the cable-termination region 154. To this end, each of the cover extensions 208 may include one or more cover tabs that extend alongside the cable-termination region 154. In the illustrated embodiment, the cover extension 208 includes a pair of cover tabs 222, 224, but the cover extension 208 may include only a single tab or more than two tabs in other embodiments. When the electrical connector 102 is assembled, the side surface 202 along the connector and cover portions 206, 207 may be referred to as an outer surface 203 (FIG. 3) that faces away from the cable-termination region 154, and the side surface 200 may be referred to as an inner surface 201 (FIG. 4) that faces generally toward the cable-termination region 154.

In particular embodiments, the cover extensions 208 include drain wire termination features (DWTFs) 220 that are configured to facilitate mechanically and electrically coupling a drain wire 264 (shown in FIG. 7) of the communication cable 110 (FIG. 1) to the module shield 124. For example, the DWTF 220 may constitute an opening that is sized and shaped to receive the drain wire 264. More particularly, the opening may be a slot that extends from an edge of the cover extension 208 toward the connector portion 206. However, the slot shown in FIGS. 3 and 4 is just one example of a DWTF 220. Other features may be used that facilitate mechanically and electrically coupling the drain wire 264 to the module shield 124. Also shown in FIGS. 3 and 4, the cover tabs 222, 224 may be shaped to curve or bend in a common direction to at least partially surround the corresponding cable-termination region 154.

The coupling elements 216 project in a common direction from the base portion 204 toward ground contacts 232 (shown in FIG. 5). The body connectors 218 also project in a common direction away from the connector portion 206. The body connectors 218 are configured to hold the module shield 124 against the dielectric body 150. In the illustrated embodiment, the coupling elements 216 and the body connectors 218 are features that are located along the edges of the module shield 124 and shaped (e.g., bent) in a predetermined manner. However, in other embodiments, the various structural features of the module shield 124 may be attached or coupled to other parts of the module shield 124.

As shown in FIG. 4, the body connector 218 includes a tab portion 226 having a spring member 228. The tab portion 226 is bent in a direction that is substantially orthogonal to the connector portion 206. The spring member 218 is biased to resist deflection toward the base or connector portions 204, 206.

FIG. 5 is an isolated view of the lead frame 230 having the electrical contacts 152, which include the ground contacts 232 and signal contacts 234. The lead frame 230 may be part of one contact module 118. The signal contacts 234 are arranged in pairs with one or more ground contacts 232 extending between adjacent pairs of the signal contacts 234. As indicated in FIG. 5, the signal and ground contacts 234, 232 are arranged in a ground-signal-signal (G-S-S) pattern beginning from the top of the lead frame 230. An adjacent contact module (not shown) can have a lead frame with a reverse pattern (i.e., an S-S-G pattern beginning from the top). However, the pattern shown in FIG. 5 is only exemplary and the signal and ground contacts 234, 232 may be arranged in other patterns. As shown, the signal and ground contacts 234, 232 can extend generally parallel to one another. In the illustrated embodiment, the signal and ground contacts 234, 232 extend generally in a linear manner parallel to the mating axis 191 (FIG. 1). However, in other embodiments, the signal and ground contacts 234, 232 may curve or bend to form a right-angle configuration.

The signal contacts 234 include mating ends 238 and wire-terminating ends 240. The ground contacts 232 include mating ends 242 and ground-terminating ends 244. The mating ends 238, 242 can be substantially even. In an exemplary embodiment, the wire-terminating ends 240 extend beyond the ground-terminating ends 244. The wire-terminating ends 240 are configured to be exposed to an exterior of the dielectric body 150 (FIG. 2) along the loading side 108 (FIG. 1). As shown, pairs of wire-terminating ends 240 are located proximate to each other. Each pair of wire-terminating ends 240 may be located within a corresponding cable-termination region 154 (FIG. 2). In the illustrated embodiment, the ground-terminating ends 244 are not substantially even with the wire-terminating ends 240. However, the ground-terminating ends 244 can be substantially even with the wire-terminating ends 240 in alternative embodiments.

Also shown in FIG. 5, the ground contacts 232 may include one or more segments that extend between adjacent pairs of the signal contacts 234. For example, the ground contact 232A includes a single segment that extends between the corresponding mating end 242 and ground-terminating end 244. However, the ground contacts 232B and 232C include base segments 250 and branch segments 252. In an exemplary embodiment, each branch segment 252 projects from and then extends substantially parallel to a corresponding base segment 250. As such, each signal contact 234 may have a segment of the adjacent ground contact 232 extending therealong for at least a portion of the length of the signal contact 234. In alternative embodiments, the ground contacts 232 may not have any ground branches or may have more than one ground branch.

The ground-terminating ends 244 can also be exposed to the exterior of the dielectric body 150. For example, the ground contacts 232 may include grippable features 246 that are exposed to the exterior through body cavities 248 (shown in FIGS. 6 and 7) of the dielectric body 150. The grippable features 246 are illustrated as narrowed portions of the ground contacts 232. However, the grippable features 246 can be any structure of the ground contact 232 that is configured to frictionally engage the coupling element 216 (FIG. 3). In other embodiments, the ground-terminating ends 244 extend beyond the dielectric body 150 where the drain wire 264 (FIG. 7) can be mechanically and electrically coupled thereto.

Figure 6:
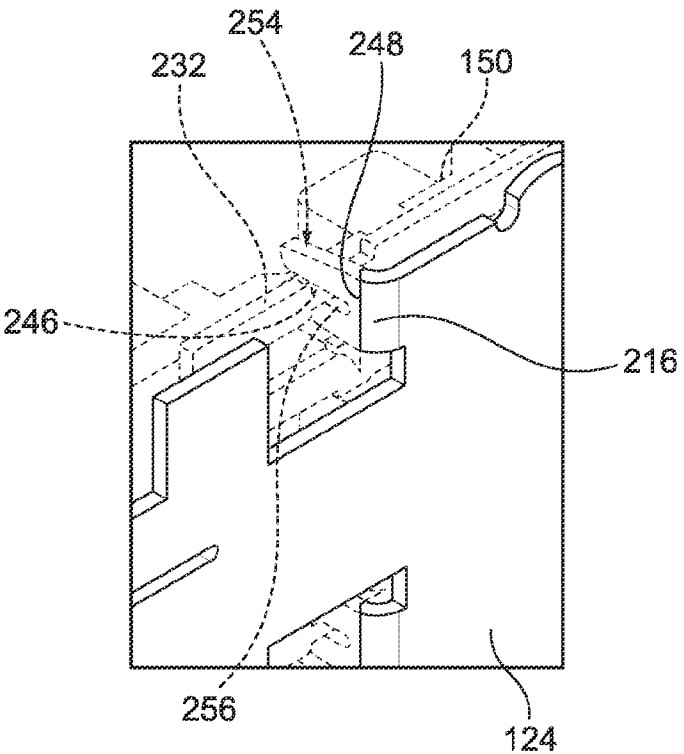
FIG. 6 is an enlarged view of the module shield engaging a ground contact in the contact module.

FIG. 6 is an enlarged view of the contact module 118 (FIG. 1) illustrating the module shield 124 engaging a ground contact 232 (shown in phantom). The body cavity 248 of the dielectric body 150 is sized and shaped to receive the coupling element 216. The coupling element 216 is illustrated as a tab 254 having a slot 256. The slot 256 is sized and shaped to receive the grippable feature 246 of the ground contact 232 when the module shield 124 is mounted to the dielectric body 150. However, the coupling element 216 is not required to mechanically couple to (e.g., grip or attach) the ground contact 232, but may only electrically couple to the ground contact 232. For example, the coupling element 216 can be a resilient beam that presses against the ground contact 232 to establish an electrical connection but does not mechanically couple to the ground contact 232. In such embodiments, the module shield 124 could be mechanically coupled to the dielectric body 150 through other mechanisms.

Figure 7:
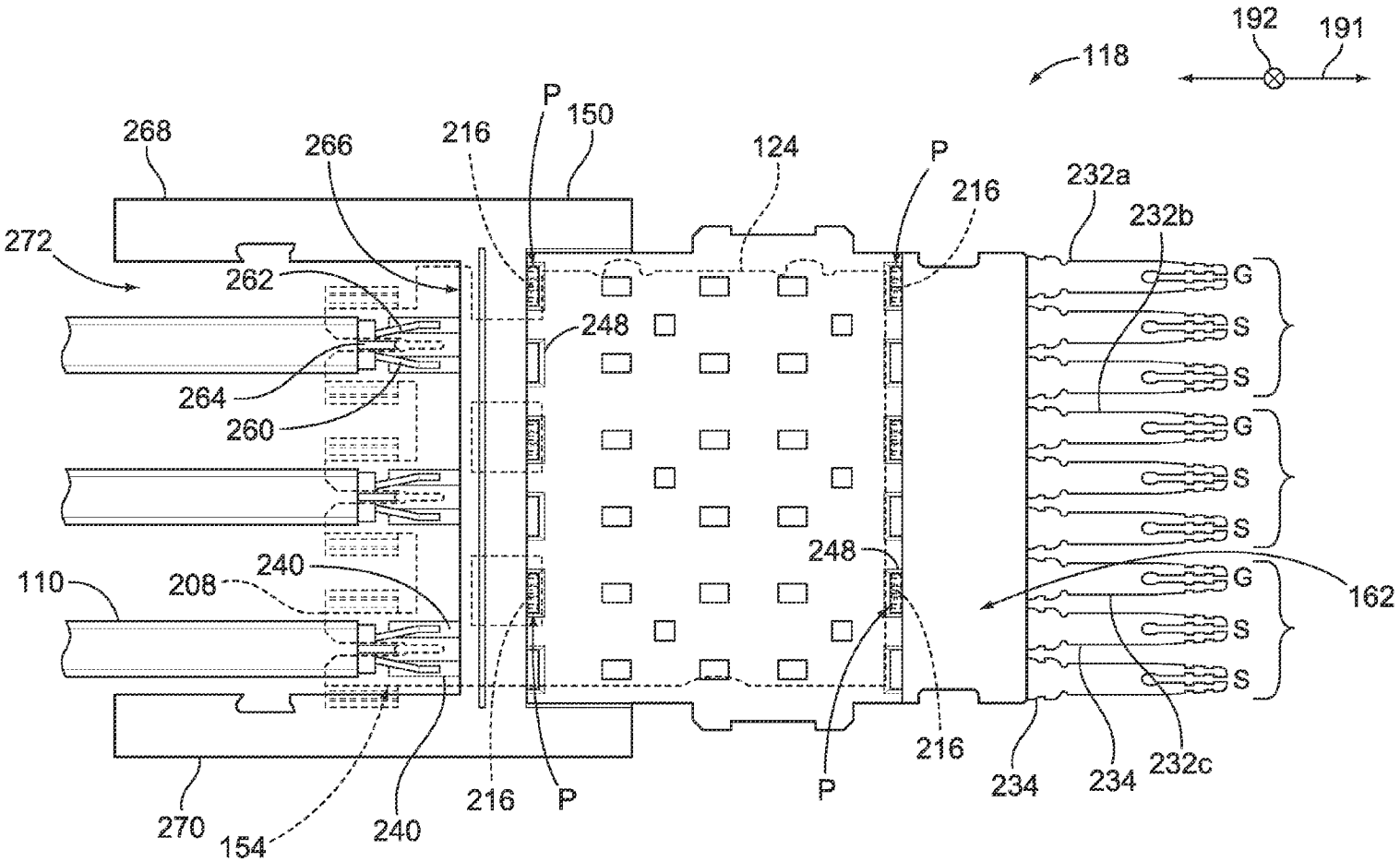
FIG. 7 is a plan view of the contact module and shows the module shield in phantom.

FIG. 7 is a view of the body side 162 of the contact module 118. For illustrative purposes, the module shield 124 is shown in phantom. The module shield 124 is mounted over the dielectric body 150 thereby defining a portion of the body side 162. In those embodiments that include a plurality of contact modules 118 stacked side-by-side, the module shield 124 may be located between the signal contacts 234 of the corresponding contact module 118 and the signal contacts 234 of the adjacent contact module 118. As such, the module shield 124 can shield the signal contacts 234 of one contact module 118 from the signal contacts 234 of the other contact module 118.

In an exemplary embodiment, each of the ground contacts 232A-C is electrically coupled to the module shield 124 at one or more contact points P. For instance, the module shield 124 includes six coupling elements 216 that grip the ground contacts 232A-C. In an exemplary embodiment, each of the ground contacts 232A-232C is mechanically and electrically coupled to the module shield 124 at two separate contact points P along the length of the corresponding ground contact 232. However, in other embodiments, there may be fewer or more coupling elements 216 and/or each of the ground contacts 232A-232C may be mechanically and electrically coupled to the module shield 124 at one contact point P or more than two contact points P.

The dielectric body 150 includes a loading edge 266 and legs 268, 270. The loading edge 266 and the legs 268, 270 define a cable-receiving space 272 where the cable-termination regions 154 are located. The contact module 118 is configured to allow the wire-terminating ends 240 of the signal contacts 234 to be mechanically and electrically coupled to the communication cable 110. For example, the wire-terminating ends 240 may project from the loading edge 266 into the cable-receiving space 272 such that the wire-terminating ends 240 are exposed to the exterior of the dielectric body 150 within the cable-receiving space 272. For each pair of signal contacts 234, the wire-terminating ends 240 are located proximate to each other in a corresponding one cable-termination region 154. As shown, the cover extensions 208 extend beyond the loading edge 266 into the cable-receiving space 272.

In the illustrated embodiment, the communication cable 110 is a twisted-pair cable that includes signal conductors 260, 262 and a single drain wire 264. However, as discussed above, the communication cable 110 may have other cable constructions, such as a parallel pair single-drain construction or a parallel-pair dual drain construction. To terminate the signal conductors 260, 262 to the wire-terminating ends 240, the jackets/insulation of the communication cable 110 are removed thereby exposing the signal conductors 260, 262 and the drain wire 264. The drain wire 264 may be bent to extend in a direction orthogonal to the mating axis 191, such as parallel to the lateral axis 192. More specifically, the drain wire 264 may be extending in a direction out of the page in FIG. 7.

Figure 8:
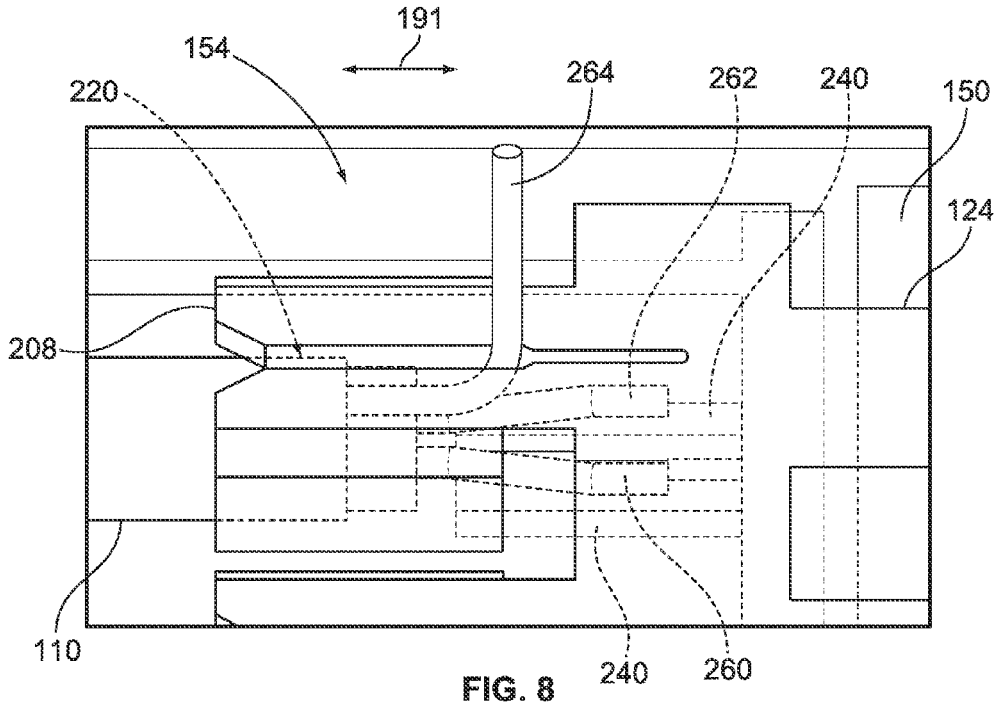
FIG. 8 is an enlarged perspective view of a cable-termination region of the connector assembly of FIG. 1.
Figure 9:
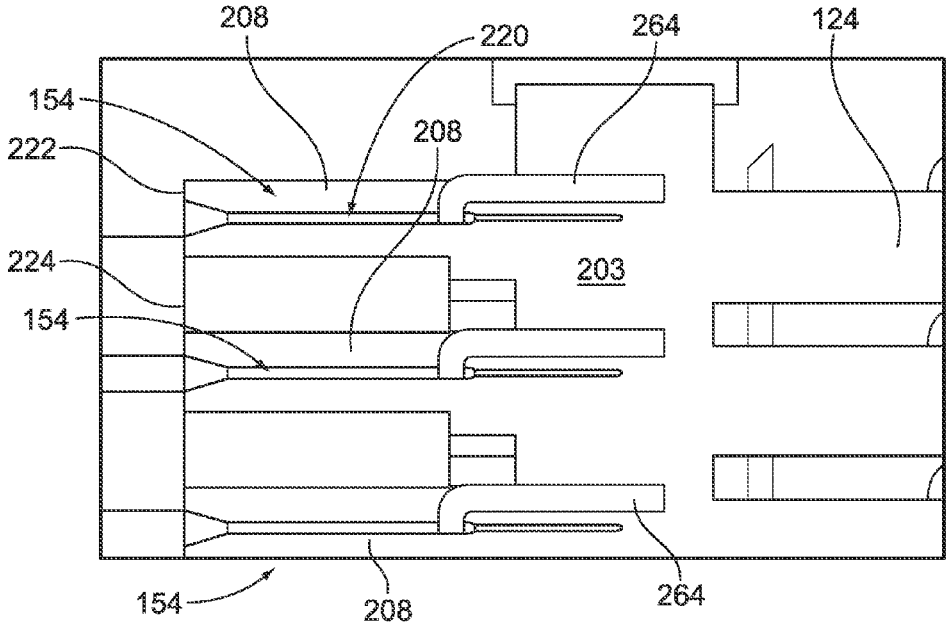
FIG. 9 is an enlarged perspective view of a plurality of cable-termination regions covered by the module shield.

FIG. 8 is an enlarged perspective view of a single cable-termination region 154. In FIG. 8, portions of the communication cable 110 that are covered by the cover extension 208 are shown in phantom. FIG. 9 shows three cable-termination regions 154 at a similar view as shown in FIG. 8. In FIG. 9, the drain wires 264 are positioned to be mechanically and electrically coupled to the module shield 124. As shown in FIG. 8, during assembly and prior to termination of the communication cable 110, the signal conductors 260, 262 are positioned proximate to the corresponding wire-terminating ends 240. For example, if the module shield 124 is already mounted to the dielectric body 150, the communication cable 110 may be moved under the cover extension 208 to position the signal conductors 260, 262 proximate to the wire-terminating ends 240. As the signal conductors 260, 262 are positioned, the drain wire 264 may be advanced through the DWTF 220 (e.g., slot) in a direction along the mating axis 191. The signal conductors 260, 262 may then be mechanically and electrically coupled (e.g., through soldering or welding) to the wire-terminating ends 240. Alternatively, if the module shield 124 is not mounted to the dielectric body 150, the signal conductors 260, 262 may first be mechanically and electrically coupled to the wire-terminating ends 240 and then the module shield 124 may be lowered onto the dielectric body 150. The drain wire 264 can be received by the DWTF 220 as the module shield 124 is lowered onto the dielectric body 150.

Optionally, after the module shield 124 is mounted to the dielectric body 150, the drain wire 264 may then be moved closer to the outer surface 203 (FIG. 9) of the module shield 124. For example, as shown in FIG. 9, a portion of the drain wire 264 that projects beyond the outer surface 203 may be bent toward the outer surface 203 thereby positioning the drain wire 264 to be mechanically and electrically coupled to the outer surface 203. In other embodiments, the drain wire 264 is bent prior to insertion of the drain wire 264 into the DWTF 220. In yet other embodiments, the drain wire 264 is not bent a second time but is soldered directly to the module shield 124 after the signal conductors 260, 262 (FIG. 7) are located within the cable-termination region 154.

In alternative embodiments, the drain wire 264 may form an interference fit with the cover extension 208 thereby establishing the mechanical and electrical coupling. For example, if the DWTF 220 includes a slot, the drain wire 264 may be pressed into a portion of the slot. The slot may have dimensions that are slightly smaller than dimensions of the drain wire 264 thereby establishing a frictional fit. Other terminating methods may also be possible. Regardless of the method of termination, when the drain wires 264 are mechanically and electrically coupled to the module shield 124, the drain wires 264 are electrically common to the module shield 124.

As shown in FIG. 9, the shielding of the cable-termination region 154 by the cover extensions 208 can be balanced on both sides. For example, the cover tabs 222, 224 extend in opposite directions away from the DWTF 220 and are similarly sized and shaped. Each of the cover tabs 222, 224 may curve about the cable-termination region 154. As such, the electrical connection may have a more balanced impedance and capacitance. With the cover extension 208 at least partially surrounding the cable-termination region 154, the electrical performance can be closer to a dual-drain cable construction. Moreover, the cover extension 208 may permit the use of twisted-pair cable constructions, which can be more flexible than the parallel-pair cable constructions. However, as described above, embodiments described herein are not limited to twisted-pair cable constructions, but may also be suitable for other cable constructions.

Figure 10:
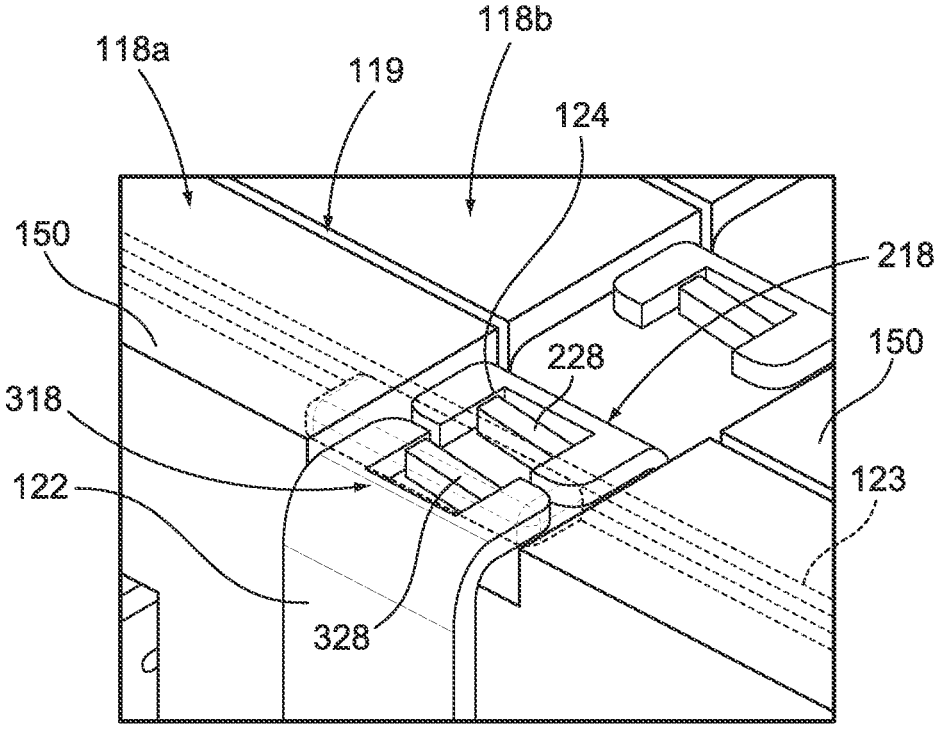
FIG. 10 is an enlarged perspective view of contact modules stacked side-by-side.

FIG. 10 is an enlarged perspective view of one of the outer contact modules 118A and an adjacent inner contact module 118B. The outer and inner contact modules 118A, 118B are stacked side-by-side in FIG. 10 with the interface 119 extending therebetween. The connector shield 123 is shown in phantom. As shown, the contact module 118A has two module shields 122, 124. The module shield 122 may have similar features as the module shield 124. However, the module shield 122 is configured to face or oppose the module shield 124 with the dielectric body 150 of the contact module 118A therebetween. As such, the dielectric body 150 of the contact module 118A is sandwiched between the module shields 122, 124. Also shown in FIG. 10, the module shield 124 includes the body connector 218 and the module shield 122 includes a body connector 318. Each of the body connectors 218, 318 includes a corresponding spring member 228, 328. The spring members 228, 238 are biased away from the dielectric body 150.

Although not shown in FIG. 10, the module shield 122 may have another body connector that opposes the body connector 318. Likewise, the module shield 124 may include another body connector that opposes the body connector 218. Those body connectors not shown in FIG. 10 may also include spring members. In the illustrated embodiment, the dielectric body 150 is positioned between the two body connectors 318 of the module shield 122 and the two body connectors 218 of the module shield 124. In some embodiments, the body connectors 218, 318 grip the dielectric body 150.

Figure 11:
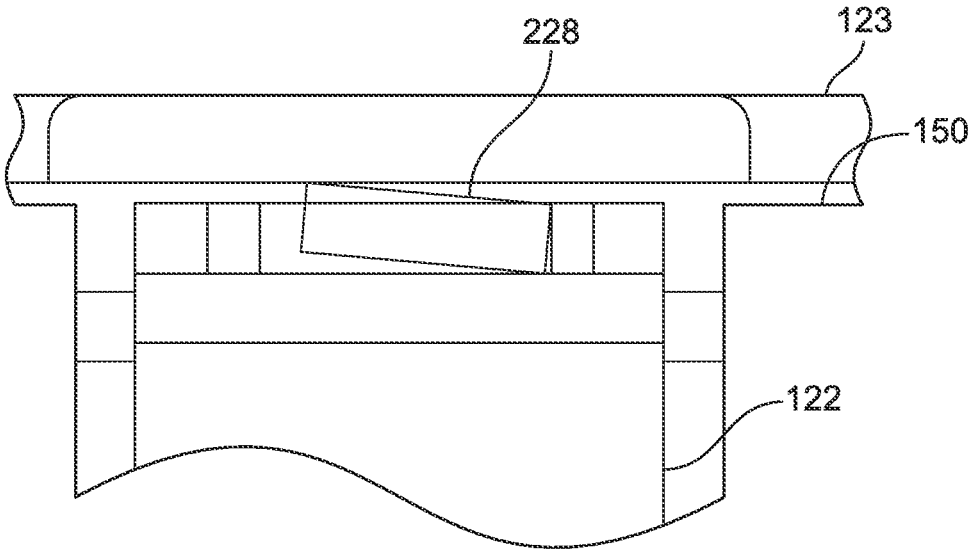
FIG. 11 illustrates a mechanism for electrically coupling the module shield to another ground shield of the connector assembly.

FIG. 11 illustrates a mechanism for electrically coupling the module shields 122, 124 (FIG. 1) to the connector shield 123. Although FIG. 11 only shows the module shield 122, the module shield 124 may also be electrically coupled to the connector shield 123 in a similar manner. As shown, the spring member 228 is biased away from the dielectric body 150 and is configured to engage the connector shield 123. The connector shield 123 may be mechanically coupled to the contact modules 118 (FIG. 1) through one or more frictional engagements. When the connector shield 123 is coupled to the contact modules 118, the connector shield 123 engages the spring member 228 and deflects the spring member 228 toward the dielectric body 150. The spring member 228 resists deflection and maintains a force against the connector shield 123 thereby maintaining an electrical connection.

Although not shown, each of the module shields 122, 124 may electrically couple to the connector shield 123 in a similar manner. Accordingly, embodiments described herein include module shields, wherein a plurality of cable drain wires may directly couple to a module shield using cover extensions of the module shield. The module shield, along with other similar module shields, may be electrically coupled to a same connector shield. Thus, numerous cables may be electrically common to the same shielding structure. In particular embodiments, each and every communication cable 110 is electrically common to the same connector shields 121, 123.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector for terminating a cable having a pair of signal conductors and a drain wire, the electrical connector comprising a dielectric body and electrical contacts held by the dielectric body, the electrical contacts including a pair of signal contacts having respective mating ends configured to engage a communication connector and also having respective wire-terminating ends, the wire-terminating ends being located proximate to each other in a cable-termination region, wherein the wire-terminating ends extend beyond the dielectric body at the cable-termination region for mechanically and electrically coupling to corresponding signal conductors of the cable, the electrical connector further comprising a ground shield that extends alongside the dielectric body, the ground shield having a cover extension that extends beyond the dielectric body and directly over the cable-termination region, the cover extension configured to shield the cable-termination region.

2. The electrical connector of claim 1, wherein the cover extension has a drain wire termination feature that facilitates mechanically and electrically coupling the drain wire to the ground shield.

3. The electrical connector of claim 2, wherein the drain wire termination feature includes an opening that is sized and shaped to receive the drain wire.

4. The electrical connector of claim 2, wherein the drain wire termination feature includes a slot that extends from an edge of the cover extension and is configured to receive the drain wire.

5. The electrical connector of claim 1, wherein the electrical contacts include a ground contact, the ground shield being mechanically and electrically coupled to the ground contact.

6. The electrical connector of claim 1, wherein the dielectric body, the electrical contacts, and the ground shield define a contact module, the electrical connector including a plurality of said contact modules.

7. The electrical connector of claim 6, wherein the cover extension of at least one contact module separates the cable-termination region of the at least one contact module from the cable termination region of an adjacent contact module.

8. The electrical connector of claim 6, wherein the ground shields of the plurality of contact modules are electrically coupled to a same connector shield that engages the plurality of contact modules.

9. The electrical connector of claim 1, further comprising the signal conductors and the drain wire, the drain wire being mechanically and electrically coupled directly to the cover extension.

10. The electrical connector of claim 9, wherein the cover extension includes an inner surface that faces the cable-termination region and an outer surface that faces away from the cable-termination region, the drain wire being directly coupled to the outer surface.

11. The electrical connector of claim 1, wherein the dielectric body includes a loading edge that faces the cable-termination region, the wire-terminating ends projecting from the loading edge into the cable-termination region, wherein the ground shield extends rearwardly beyond the loading edge to extend directly over the cable-termination region.

12. The electrical connector of claim 1, wherein, at the cable termination region, dielectric material does not exist between the wire-terminating ends and at least a portion of the cover extension.

13. The electrical connector of claim 1, wherein the ground shield includes a base portion that resides within a shield plane, the cover extension projecting from the base portion and extending along the shield plane, the cover extension including at least one cover tab that is bent or curved such that a portion of the at least one cover tab extends out of the shield plane, the at least one cover tab at least partially surrounding the cable-termination region.

14. The electrical connector of claim 1, wherein the wire-terminating ends extend parallel to each other and to a cable axis that is located between the wire-terminating ends, the cover extension being shaped to extend around the cable axis and at least partially surround the cable-termination region.

15. The electrical connector of claim 1, wherein the electrical connector includes a plurality of the cable-termination regions and a plurality of the cover extensions, the cover extensions clearing the dielectric body and extending directly over and shielding respective cable-termination regions, wherein adjacent cover extensions of said plurality are spaced apart from each other.

16. The electrical connector of claim 1, wherein the ground shield includes a base portion that extends directly alongside the dielectric body and proximate to the electrical contacts, the cover extension projecting from the base portion.

17. A connector assembly comprising:

a communication cable comprising a pair of signal conductors and a drain wire; and an electrical connector comprising a dielectric body and electrical contacts held by the dielectric body, the electrical contacts including a pair of signal contacts having respective mating ends and respective wire-terminating ends, the wire-terminating ends being located proximate to each other in a cable-termination region, the signal conductors of the cable being mechanically and electrically coupled to the wire-terminating ends, wherein the electrical connector also includes a ground shield that is coupled to the dielectric body, the ground shield having a cover extension that extends directly over the cable-termination region to shield the cable-termination region, wherein the cover extension has a drain wire termination feature, the drain wire being directly coupled to the drain wire termination feature of the cover extension.

18. The connector assembly of claim 17, wherein the drain wire termination feature includes an opening of the cover extension, the drain wire being received within the opening.

19. The connector assembly of claim 17, wherein the signal conductors are twisted about the drain wire along a length of the cable or extend parallel to each other along the length of the cable.

20. An electrical connector comprising:

contact modules, each of the contact modules including a dielectric body and electrical contacts held by the dielectric body, the electrical contacts including a pair of signal contacts having respective mating ends configured to engage a communication connector and also having respective wire-terminating ends, the wire-terminating ends being located proximate to each other in a cable-termination region and configured to mechanically and electrically couple to corresponding signal conductors;

module shields separating the signal contacts of one contact module from the signal contacts of an adjacent contact module; and a connector shield coupled to the contact modules and electrically coupled to each of the module shields.

21. The electrical connector of claim 20, wherein the connector shield extends substantially orthogonal to the module shields and directly contacts an element of each of the module shields thereby electrically coupling the connector shield to the module shields.

22. The electrical connector of claim 20, wherein the contact modules are stacked side-by-side, the contact modules including two outer contact modules and inner contact modules located between the two outer contact modules, one of the outer contact modules having two module shields that oppose each other with the corresponding dielectric body therebetween.

* * * * *